US009896244B2

(12) United States Patent
Stanek et al.

(10) Patent No.: US 9,896,244 B2
(45) Date of Patent: Feb. 20, 2018

(54) LINKABLE WORKSTATIONS

(71) Applicant: ENPAC, L.L.C., Eastlake, OH (US)

(72) Inventors: Lawrence C. Stanek, Akron, OH (US); Timothy D. Reed, Northfield Center, OH (US); Scott R. Janda, Chagrin Falls, OH (US); Robert D. Heintz, Chardon, OH (US)

(73) Assignee: ENPAC, L.L.C., Eastlake, OH (US)

( * ) Notice: Subject to any disclaimer, the term of this patent is extended or adjusted under 35 U.S.C. 154(b) by 246 days.

(21) Appl. No.: 14/709,033

(22) Filed: May 11, 2015

(65) Prior Publication Data

US 2015/0321791 A1 Nov. 12, 2015

Related U.S. Application Data

(60) Provisional application No. 61/991,161, filed on May 9, 2014.

(51) Int. Cl.

| | |
|---|---|
| ***B65D 19/04*** | (2006.01) |
| ***B65D 43/02*** | (2006.01) |
| ***B65D 19/00*** | (2006.01) |
| ***B65D 19/38*** | (2006.01) |
| ***B65D 21/02*** | (2006.01) |
| ***B65D 25/20*** | (2006.01) |

(Continued)

(52) U.S. Cl.

CPC ..... *B65D 43/0212* (2013.01); *B65D 1/34* (2013.01); *B65D 19/0002* (2013.01); *B65D 19/04* (2013.01); *B65D 19/385* (2013.01); *B65D 21/0204* (2013.01); *B65D 21/0233* (2013.01); *B65D 25/20* (2013.01); *B65D 85/84* (2013.01); *B65D 2519/008* (2013.01); *B65D 2519/0094* (2013.01); *B65D 2519/00507* (2013.01); *B65D 2543/0012* (2013.01); *B65D 2543/00296* (2013.01); *B65D 2543/00361* (2013.01); *B65D 2543/00537* (2013.01); *B65D 2543/00657* (2013.01); *B65D 2543/00694* (2013.01); *B65D 2543/00768* (2013.01); *B65D 2543/00805* (2013.01); *Y10T 29/49828* (2015.01)

(58) Field of Classification Search

CPC .. B65D 1/34; B65D 43/0212; B65D 21/0204; B65D 21/0233; B65D 2543/00361; B65D 19/04; B65D 19/385; B65D 25/20

USPC ..... 220/23.4, 23.6, 23.8, 23.2; 108/53.1, 108/53.3, 57.13, 64

See application file for complete search history.

(56) References Cited

U.S. PATENT DOCUMENTS 5,249,699 A * 10/1993 Williams ..... B65D 19/0063 108/55.1

5,562,047 A 10/1996 Forney et al.

(Continued)

*Primary Examiner* — King M Chu

(74) *Attorney, Agent, or Firm* — Rankin, Hill and Clark LLP

(57) ABSTRACT

Linkable workstations are provided that define a reservoir for containing liquid. The linkable workstations can be nested together in a compact vertical space. The workstations include a plurality of high rim portions and a plurality of low rim portions. The high rim portions on a workstation are configured to overlap a low rim portion of another workstation to link workstations side to side to form custom configurations. The workstations include overflow channels that allow for the sharing of the liquid containing capacity between linked workstations, and which can be selectively sealed to prevent fluid from flowing therethrough.

16 Claims, 9 Drawing Sheets

(51) Int. Cl.
*B65D 1/34* (2006.01)
*B65D 85/84* (2006.01)

(56) References Cited

U.S. PATENT DOCUMENTS 6,607,091 B2 * 8/2003 Gasbarro ..... A47J 27/10
220/23.4
6,622,879 B1 9/2003 Carter

* cited by examiner

LINKABLE WORKSTATIONS

CROSS-REFERENCE TO RELATED APPLICATIONS

This application claims priority to U.S. Provisional Application 61/991,161, filed May 9, 2014, which is incorporated herein by reference.

BACKGROUND OF INVENTION

Field of Invention

The present invention relates to workstations within which liquid, such as liquid leaking from containers, can be retained.

Description of Related Art

Liquid containers such as steel drums, plastic drums, and the like are frequently used in industrial settings. Such containers can contain liquid materials that should not be placed into sewage or drain systems, or be allowed to reach the soil. Thus, regulations have been adopted to contain liquids from drums in the event of a leak or catastrophic failure of the drum.

One method of reducing the likelihood that liquids will reach drains or otherwise contaminate a work area, includes placing the drums in a workstation (also known in the art as a low profile a spill pallet, a drum deck, etc.), which can collect a substantial volume of liquid material that may leak from the container.

Conventional workstations generally constitute independent structures, which are not fluidly linked together and thus define a predetermined volume for containing such liquids. Thus, there is no way to expand their capacity for containing liquids except, for example, if one were to somehow connect two units together using a hose extending between the two units as is known in the art. This conventional process of connecting two units using a hose is relatively complicated and requires that a hole be formed in a wall of each of the units, and requires connecting componentry, such as the hose to transport the liquid from one unit to another, and gaskets, damps, and the like for fluidly sealing the connection and the holes in the was of the units. This connecting componentry is auxiliary to the unit itself and thus represents an additional cost for a consumer. Furthermore, this connection type between two units is fairly cumbersome to arrange and does not prohibit movement of the two workstations relative to each other, which may be desired in certain circumstances. The hole in the side wall of the units that is necessary for fluidly connecting one unit to another must be plugged with further additional componentry when not fluidly connected to another unit, thus requiring additional parts and increasing cost of the unit.

Another complication is realized when multiple conventional workstations are not in use and are stacked one on top of another for storage or transportation. In this situation, the stacked units take up a relatively large amount of vertical space that is commensurate to the combined heights of the walls of the units, thus further increasing cost of transportation or storage.

BRIEF SUMMARY OF THE INVENTION

In view of the foregoing, the present invention is directed toward workstations that can be linked while in use to form custom configurations that restrict movement of the linked workstations relative to each other. When linked, several configurations allow for the sharing of the liquid containing capacity between the linked workstations. The workstations can also have walls that are angled (i.e. not perpendicular) relative to the base, which allows several workstations to be stacked one upon another in a nested configuration, thereby occupying a compact vertical space compared to workstations that cannot be nested.

In one embodiment, the present subject matter provides a linkable workstation comprising a base portion configured to rest on a surface, and walls extending upwardly from the base portion and terminating at rim portions having downwardly extending skirts. The walls cooperate with the base portion to define a reservoir for liquids. The walls are angled with respect to the base portion so as to allow substantially identical workstations to be stacked one atop another in a nested configuration. The rim portions comprise a plurality of high rim portions and a plurality of low rim portions, the plurality of high rim portions being at an elevation that is higher than an elevation of the plurality of low rim portions. The workstation is linkable to another workstation that comprises a rim portion that is identical to one of the plurality of low rim portions or to one of the plurality of high rim portions, by overlapping one of the plurality of low rim portions or one of the plurality of high rim portions of the workstation with the rim portion of the other workstation having a different elevation.

In another embodiment, the present subject matter provides a method for containing liquid escaping from a container. The method comprises providing a first linkable workstation and a second linkable workstation, wherein each workstations comprises a base portion configured to rest on a surface, and walls extending upwardly from the base portion and terminating at rim portions having downwardly extending skirts. The walls cooperate with the base portion to define a reservoir for liquids. The rim portions comprise a plurality of high rim portions and a plurality of low rim portions, the plurality of high rim portions being at an elevation that is higher than an elevation of the plurality of low rim portions. The first workstation includes a depression defining an overflow channel at a top of a wall and laterally crossing one of the plurality of high rim portions of the first workstation. The second workstation includes a depression defining an overflow channel at a top of a wall and laterally crossing one of the plurality of low rim portion of the second workstation. The method includes placing a container having liquid escaping therefrom, over the reservoir of at least one of the first and second workstations. The first and second workstations are linked such that the overflow channel of the first workstation overlaps the overflow channel of the second workstation to thereby fluidly connect the reservoir of the first workstation with the reservoir of the second workstation.

The workstations and methods of connecting them as described herein, provide increased liquid containing capacity, i.e. "sump capacity", to contain liquid leaking out of a container by sharing the sump capacity between linked workstations. For example, linked workstations with a combined sump capacity volume of 66 gallons or more (or less) can be provided, which allow the workstations to be utilized in volume-compliant applications.

The foregoing and other features of the invention are hereinafter more fully described and particularly pointed out in the claims, the following description setting forth in detail certain illustrative embodiments of the invention, these being indicative, however of but a few of the various ways in which the principles of the present invention may be employed.

DETAILED DESCRIPTION OF THE INVENTION

Figure 1:
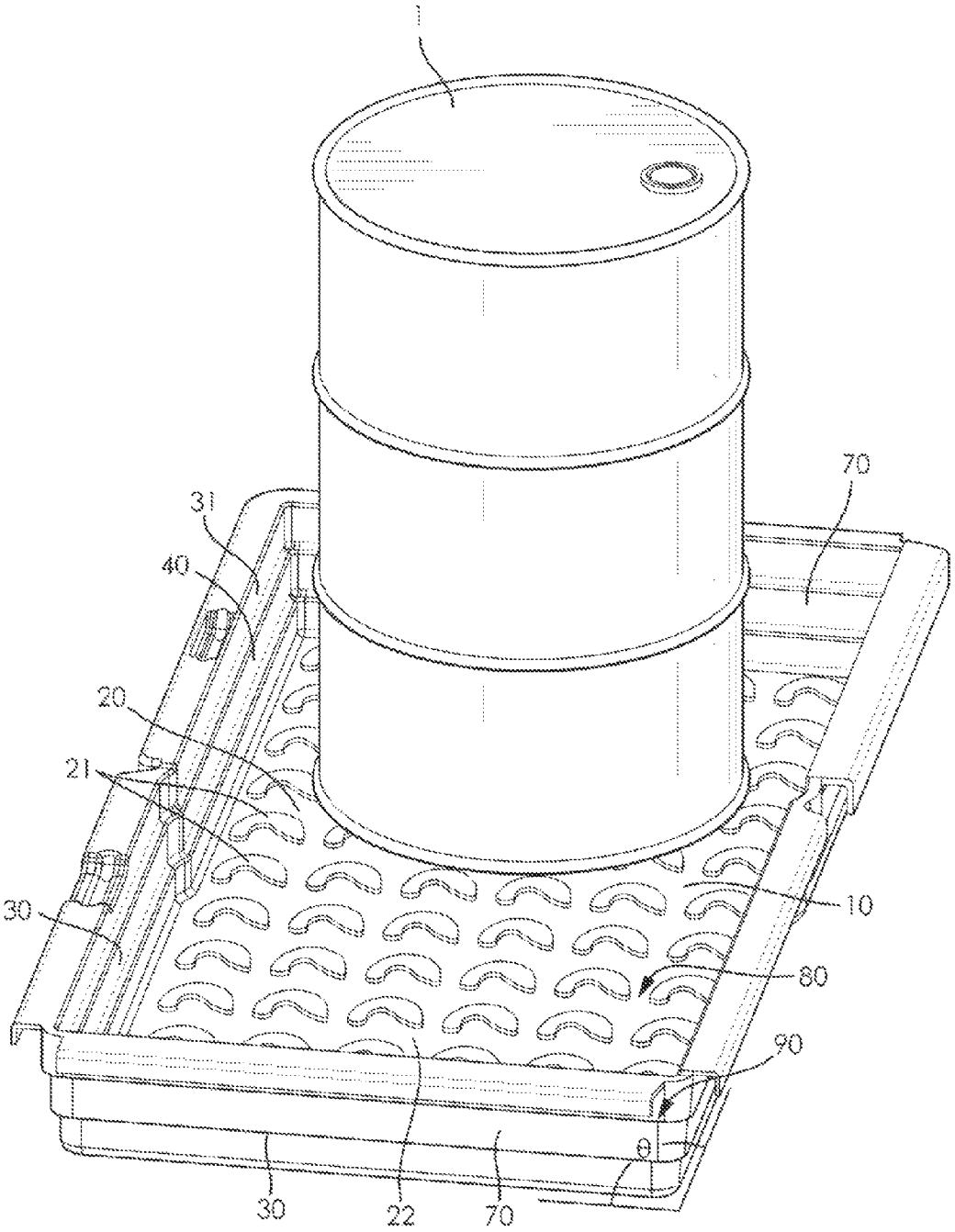
FIG. 1 is a perspective view of a container placed on a linkable workstation according to an embodiment of the invention.

The present subject matter provides workstations for containing liquids leaking from damaged containers, such as metal drums or the like. The linkable workstations include a base that is configured to rest on a horizontal or substantially horizontal surface. The linkable workstations each include walls that extend upwardly from the base and terminate at rim portions having downwardly extending skirts. The walls cooperate with the base to define a reservoir/receptacle for liquid.

Although not restricted by the present subject matter, the workstations may be made of chemical-resistant polymeric material, such as polyethylene. Preferably, they have a one-wall construction, although a double- or multi-walled construction could be used. In one embodiment, the workstations are formed by injection molding, vacuum thermoforming or other plastic molding techniques. Other methods can be used to form the workstations as desired, such as stamping, forging, pressing, or die forming a metal to form the workstations.

In several embodiments, the workstations include at least two high rim portions and at least two low rim portions. As measured from the base portion, the high rim portions are at an elevation that is higher than an elevation of the low rim portions. In this way, a workstation is linkable with another workstation that has high or low rim portions, by overlapping rims on the respective workstations that have different elevations. For example, the high rim portion of a first workstation can overlap a low rim portion of a second workstation in order to link the first and second workstations. When linked, movement of the linked workstations relative to one another is inhibited. As used herein, "elevation" refers to the height or distance of a component as measure from the base portion.

The workstations can be fluidly connected when they are linked so that the sump capacity of several workstations can be shared between them. In several embodiments, the workstations each include an overflow channel. When linked, the overflow channels may overlap so that liquid in a first workstation can transfer/flow through an overflow channel to a second linked workstation. In this way, liquid being contained in the first workstation does not overflow out of the first workstation and into the environment, but rather flows into the reservoir of the second linked workstation. The overflow channels are designed so that no special tools or attachment components are needed to fluidly connect the reservoirs of the several workstations and the linking process is quick and simple. Additionally, the liquid connection between the linked workstations does not require the formation of holes is the was of the workstations, which normally requires additional attachments for fluidly sealing the hole when not in use for transferring liquids.

In several embodiments, the walls of the workstations are angled relative to the base, thereby defining a wall angle measured through the reservoir and between the base and the wall. In one embodiment, the wall angle is greater than 90 degrees such that workstations having identical, or substantially identical wall angles can be stacked in a nested configuration, one inside the other. This nesting of several workstations allows the stack to occupy less vertical space than if the workstations were unable to be nested, thus saving on transportation cost and offering space savings for storage.

The linkable workstations in accordance with the present subject matter will now be described in more detail and with reference to the various figures.

Workstations

Figure 2:
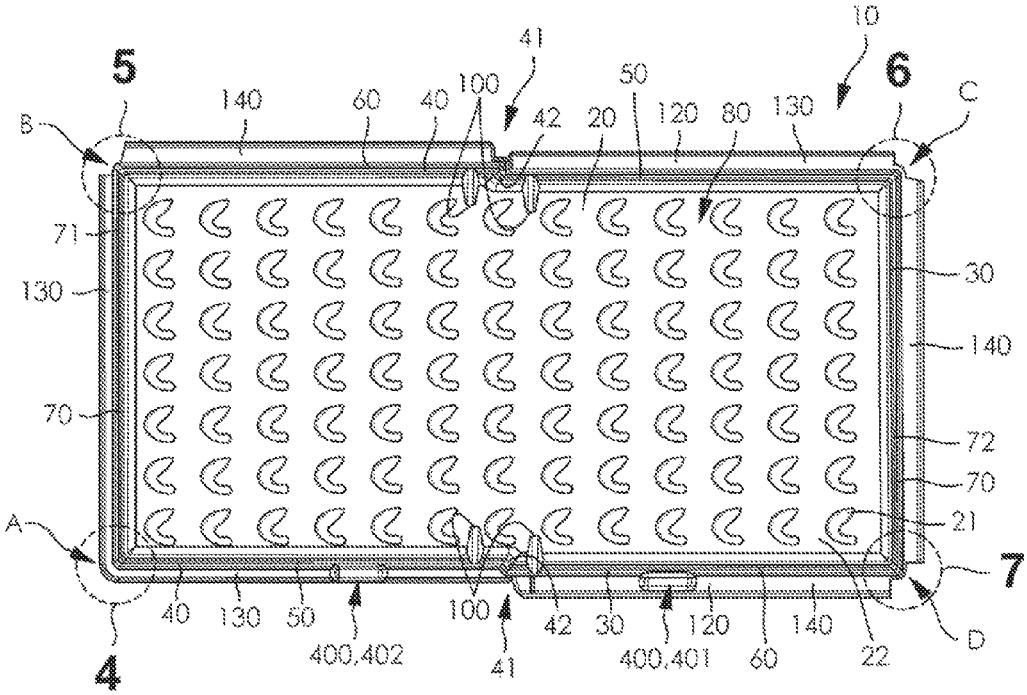
FIG. 2 is a top view of a rectangular linkable workstation according to an embodiment of the invention.

As shown in FIGS. 1-2, an exemplary linkable workstation 10 includes a base portion 20, which is shown for example to be generally rectangular in shape, and four walls 30 extending upwardly from edges of the base 20. The base 20 is configured to be placed on a horizontal or substantially horizontal surface 2 (e.g. see FIGS. 4, 10) such as a floor, and the base portion 20 cooperates with the walls 30 to define a reservoir 80 for liquid. In use, the workstation 10 may have a container 1, for example a conventional 55-gallon steel drum, placed in the reservoir 80 as shown, or above the reservoir in order to collect liquid that may leak from the container 1. This exemplary rectangular linkable workstation 10 is also referred to herein as a "two-drum" linkable workstation, wherein one drum or two drums may be placed on or above the base portion 20 of the workstation 10 as desired to collect liquid that may leak therefrom.

The base portion 20 may include a plurality of raised areas/portions 21 protruding upwardly from a land area 22 that is not raised. The raised portions 21 support the drum 1 above the land area 22. In one embodiment, a bottom side of the land area 22, and not a bottom side of the raised portions 21, rests on the horizontal surface. It will be appreciated that the number and appearance (i.e. shape and size) of the raised areas 21 is not particularly limited by the present subject matter and can vary from that depicted. Furthermore, the raised areas 21 could be omitted, if desired. That is, the base portion 20 could be substantially planar and consist of only the land area 22. The raised areas 21 may be included to improve strength and rigidity of the base portion 20 and also to elevate a container 1 above the land area 22, and can thus retain incidental liquid leakage in a manner that does not contact the bottom of the container 1. This configuration, wherein small amounts of liquid in the reservoir 80 do not contact the bottom of the container 1, may be beneficial for inhibiting corrosion (e.g. rust) of the container 1.

The walls 30 of the two-drum linkable workstation 10 can comprise two side walls 40 and two end walls 70. Each of the side walls 40 extend upwardly from one of the long sides/edges of the rectangular base portion 20, and each of the end walls 70 extend upwardly from one of the short edges of the rectangular base portion 20. In one embodiment, the side walls 40 are about two times the length of the end walls 70.

In several embodiments, the side walls 40 of the rectangular two-drum linkable workstations 10 each comprise a first offset portion 50 and a second offset portion 60, wherein the first offset portion 50 is non-coplanar to the second offset portion 60. This configuration of the workstation 10 is shown in detail in FIGS. 2 and 9-11, wherein a shoulder/step 42 transitions between the first offset portion 50 and the second offset portion 60. In one aspect, the shoulder 42 is at the midpoint 41 of the side walls 40 between the two end walls 70. It will be appreciated that location of the shoulder 42 at the midpoint 41, while preferable, is not mandatory, and that the shoulder 42 could be located other than at the midpoint 41 of the side walls 40.

In one aspect as shown in FIG. 2, the rectangular linkable workstation 10 includes braces 100 on either side of the shoulder 42 along each of the side walls 40; one brace 100 being positioned on each side wall 40 on the first offset portion 50, and one brace 100 being positioned on each side wall 40 on the second offset portions 60. The braces 100 improve the strength of the longer side walls 40 when liquid is collected in the reservoir 80. This is particularly beneficial when the workstation 10 is linked to another workstation 10 along the side wall 40, as the braces 100 provide additional strength to the opposite side wall 40 that is not linked to another workstation 10. The braces 100 may be wedge shaped—tapering upward from a wider foundation toward a narrower top edge, with the narrow top edge of the wedge pointing upwardly away from the base 20 of the workstation 10, and the wider foundation of the wedge being connected to the base portion 20 and the side walls 40 as shown. As will be understood, the wedge-shape of the braces 100 allows for compact nesting of multiple workstations 10.

Figure 3:
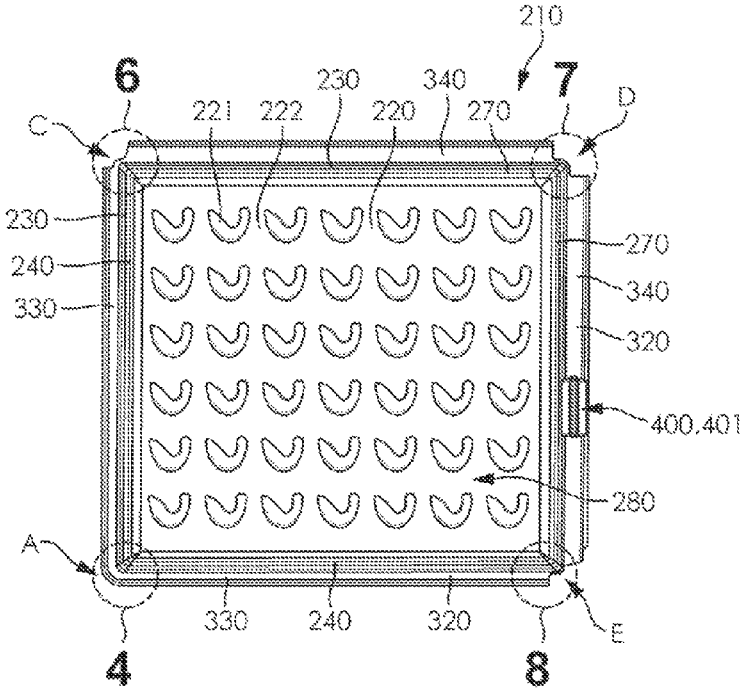
FIG. 3 is a top view of a substantially square linkable workstation according to another embodiment of the invention.

In another embodiment as depicted in FIG. 3, a workstation 210 comprises a base portion 220 that has a substantially square shape. In this embodiment, the walls 30 comprise four walls 230 that are substantially equal in length, wherein each wall 230 extends upwardly from an edge of the substantially square base portion 220. This substantially square workstation 210 is also referred to herein as a "one-drum" linkable workstation, wherein one drum, like that depicted in FIG. 1, may be placed on or above the base portion 220 of the workstation 210 as desired for collecting fluid that may leak from the drum.

The one-drum linkable workstations 210 are similar in many respects to the two-drum workstations 10 discussed herein (e.g., they feature a base portion configured to rest on a substantially horizontal surface, side ails that extend upwardly at an angle to facilitate nesting, four different corners and rims/skirts), but they are generally square in shape as opposed to being rectangular, and thus do not have a shoulder or offset portions on a wall. As in the case of the two-drum linkable workstations, the one-drum linkable workstations have two high sides and two low sides and four different corners.

Like the two-drum workstations 10, the walls 230 of the one-drum workstation 210 cooperate with the base portion 220 to define a reservoir 280 for containing liquid. Like in the two-drum workstations 10, the base portion 220 of the one-drum workstation 210 may include raised portions 221 extending upwardly from a land area 222.

Figure 7:
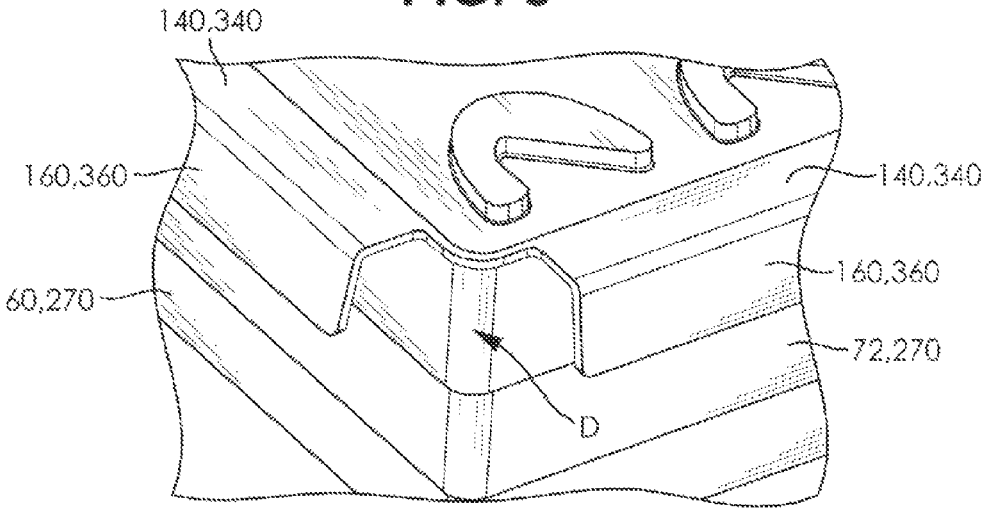
Figure 8:
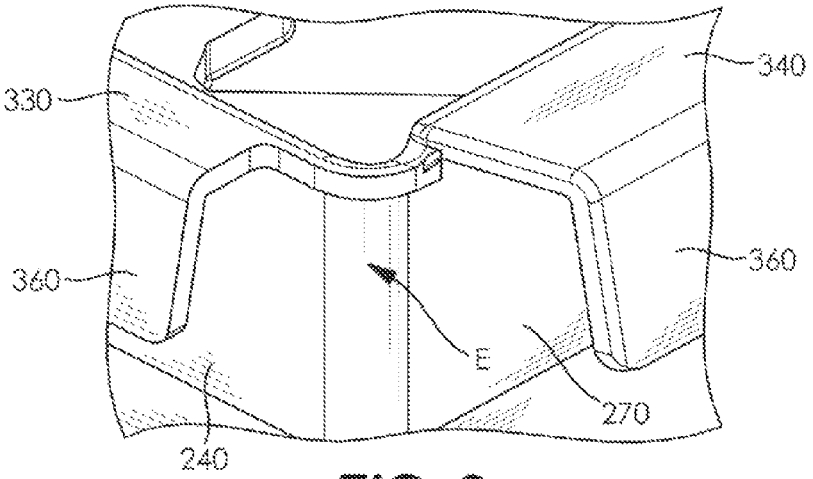
Figure 9:
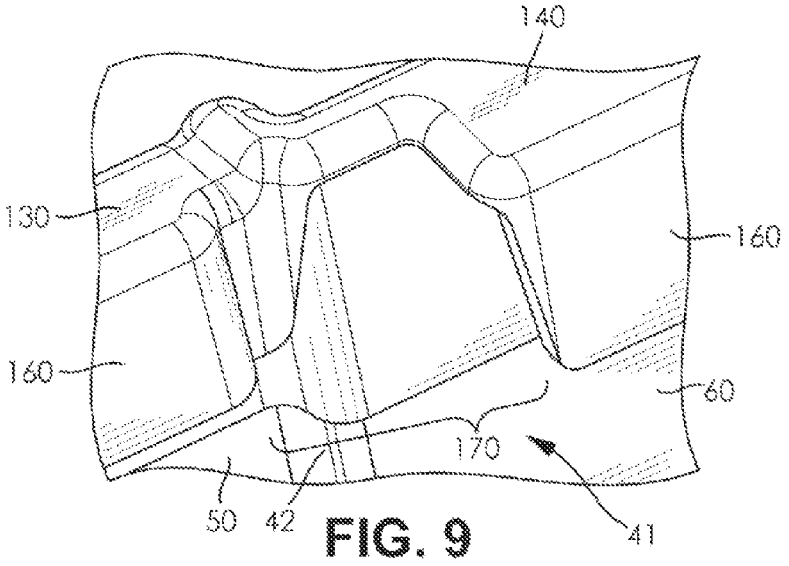
FIG. 9 is a perspective view of a gap in a skirt at a midpoint of a side wall of a rectangular linkable workstation according to an embodiment of the invention.

As can be seen in various embodiments shown in FIGS. 1-9, the walls 30 of the two-drum linkable workstations 10 terminate at the top in rim portions 120, and the walls 230 of the one-drum linkable workstations 210 terminate in a similar fashion at the top in rim portions 320. The rim portions 120, 320 of the one- or two-drum workstations may be generally parallel to the respective base portions 20, 220. Furthermore, the rims 120, 320 include respective skirts/flanges 160, 360, that extend downwardly from the rims 120, 320 on a side of the rims 120, 320 opposite from the walls 30, 230. The rims 120, 320 and respective skirts 160, 360 operate to provide increased strength and rigidity to the respective workstations 10, 210. In one embodiment as shown in FIG. 9, the skirt 160 of a two-drum workstation 10 includes a gap 170 at the transition at the shoulder 42 between the first offset portion 50 and the second offset portion 60 of the side walls 40.

In several embodiments, the rim portions 120, 320 are arranged and configured in a particular manner to thereby link several workstations together as described in more detail herein.

In this respect, the rim portions 120 of the two-drum linkable workstations 10 include at least two high rim portions 140 and at least two low rim portions 130, wherein the two high rim portions 140 are at an elevation that is higher than an elevation of the two low rim portions 130. In one embodiment, the high rim portions 140 are wider than the low rim portions 130 as depicted in detail in FIGS. 2, 5, 6, and 9.

As shown in FIG. 2, the two-drum workstations 10 include two second offset portions 60 and a high end wall 72, which all terminate in high rim portions 140. The two-drum workstations 10 also include two first offset portions 50 and a low end wall 71, which all terminating in low rim portions 130. As such, it will be understood that the two-drum linkable workstation shown in FIG. 2 includes three low rim portions 130 and three high rim portions 40.

It will also be understood that the second offset portions 60 are taller than the first offset portions 50 (i.e. the second offset portions 60 extend upwardly from the base portion 20 a greater distance than the first offset portions 50), and that the high end wall 72 is taller than the low end wall 71 (i.e. the high end wall 72 extend upwardly from the base portion 20 a greater distance than the low end wall 71).

In one aspect, the several high rim portions 140 associated with either the high end wall 72 or the two second offset portions 60, are all at the same elevation; and the several low rim portions 130 associated with either the low end wall 71 or the two first offset portions 50, are all at the same elevation.

Figure 6:
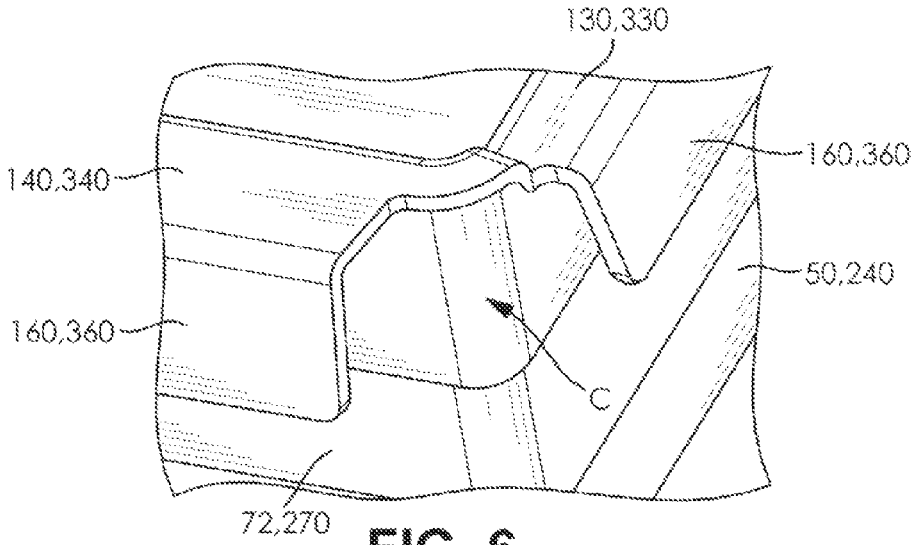

In a similar manner as the two-drum workstations 10, the rim portions 320 of the one-drum linkable workstations 210 include at least two high rim portions 340 and at least two low rim portions 330, wherein the two high rim portions 340 are at an elevation that is higher than an elevation of the two low rim portions 330. In one embodiment, the high rim portions 340 are wider than the low rim portions 330 as depicted in FIGS. 3, 6, and 8.

As shown in FIG. 3, the one-drum workstations 210 include two high walls 270 each terminating in high rim portions 340, and two low walls 240 each terminating in low rim portions 330. It will be understood that the high walls 270 are taller than the low walls 240 (i.e. the high walls 270 extend upwardly from the base portion 220 a greater distance than the low walls 240). In one aspect, the several high rim portions 340 associated with high walls 270 are all at the same elevation; and the several low rim portions 330 associated with low walls 240 are all at the same elevation.

In several embodiments, the linkable workstations 10, 210 can have four distinct corners based on the relative elevations of the rims and the heights of the walls. For example, FIGS. 2 and 4-7 show four corners (indicated A, B, C, and D) of the two-drum linkable workstations 10. FIGS. 3, 4, and 6-8 show four corners (indicated A, C, D and E) of the one-drum linkable workstations 210. Each corner A, B, C, D, and E can have a slightly different configuration as shown.

Figure 4:
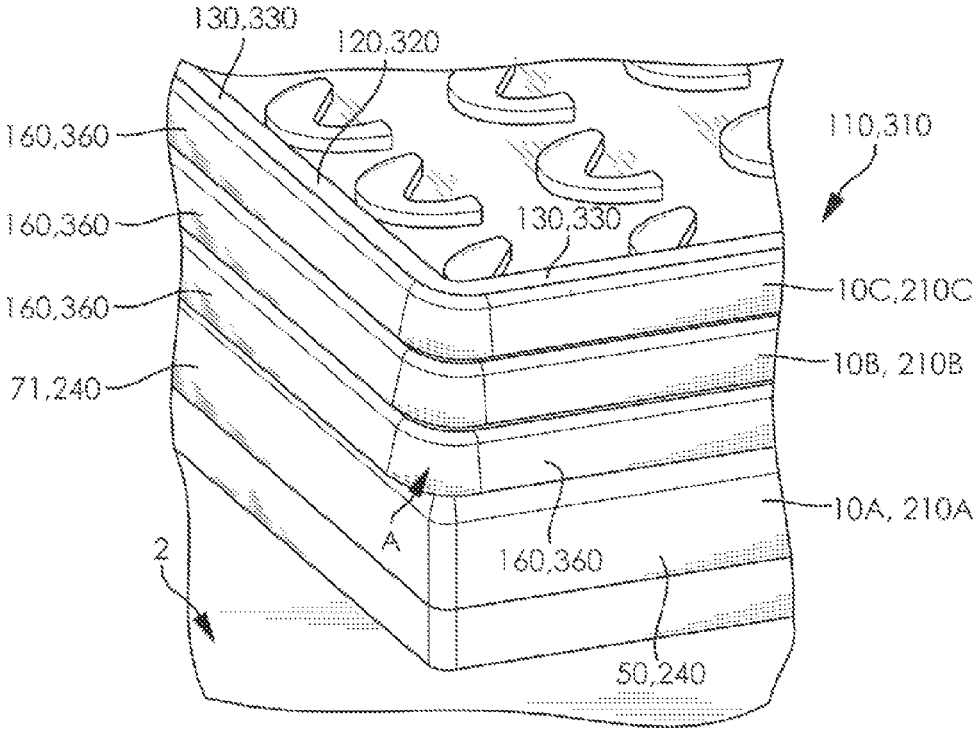
FIG. 4 is a perspective view of a corner of a stack of three nested linkable workstations according to an embodiment of the invention.

Corner A, which may be present on the one- or two-drum linkable workstations, is shown in FIGS. 2-4. As depicted in FIG. 4, and depending on the type of workstation that is used, several rectangular workstations, 10A, 10B, and 10C can be stacked in a nested configuration, wherein the stack 110 of nested workstations includes a top workstation 10C nested inside a middle workstation 10B, which is nested inside a bottom workstation 10A. As shown, the stack 110 of workstations is resting on a horizontal or substantially horizontal surface 2. Corner A on each workstation is defined by the convergence of two walls, i.e. low end wall 71 and the first offset portion 50 of a side wall, along with their corresponding low rim portions 130, 130 and skirts 160, 160. As shown, the low rim portions 130, 130 on each side of corner A are at the same elevation and thus form a continuous rim and skirt around corner A.

Similarly, several substantially square one-drum workstations 310A, 310B, and 310C can be stacked in a nested configuration as depicted in FIG. 4. The stack 310 of one-drum linkable workstations includes a top workstation 310C nested inside a middle workstation 310B, which is nested inside a bottom workstation 310A. As shown, corner A on each workstation is defined by the convergence of two walls, i.e. two low walls 240, 240 along with their corresponding low rim portions 330, 330 and skirts 360, 360. As shown, the low rim portions 330, 330 on each side of corner A are at the same elevation and thus form a continuous rim and skirt around corner A. In FIG. 4, the rim is continuous and flat around corner A, and makes no height transition as it proceeds around corner A.

Figure 5:
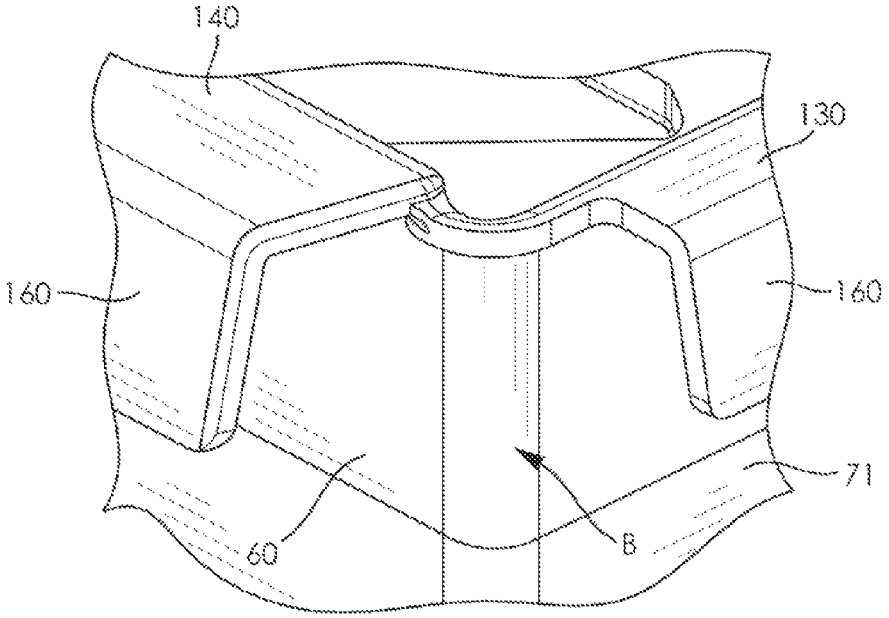
FIGS. 5-8 are perspective views of several corners of linkable workstations according to embodiments of the invention.

Corner B, which may be present on the two-drum linkable workstations 10, is shown FIGS. 2 and 5. As seen in FIG. 5, corner B is defined by the convergence of two walls, i.e. low end wall 71 with its corresponding low rim portion 130 and skirt 160, and the second offset portion 60 of a side wall with its corresponding high rim portion 140 and skirt 160. As shown, the low rim portion 130 on one side of corner B is at a different elevation than the high rim portion 140 on the other side of corner B. That is, the rims 130, 140, while generally parallel to the base, are in different planes. As such, corner B includes a notch between rim 130 and rim 140, and the respective skirts 160, 160 are separated from each other and not continuous around corner B.

Corner C, which may be present on the one or two-drum linkable workstations, is shown in FIGS. 2, 3, and 6. As depicted in detail in FIG. 6, corner C is defined by the convergence of two walls. For two-drum workstations, corner C is defined by the convergence of the first offset portion 50 of a side wall and its corresponding low rim portion 130 and skirt 160, and the high end wall 72 and its corresponding high rim portion 140 and skirt 160. As shown, the low rim portion 130 on one side of corner C is at a different elevation than the high rim portion 140 on the other side of corner C. As such, corner C includes a notch between rim 130 and rim 140, and the respective skirts 160, 160 are separated from each other and not continuous around corner C.

For one-drum workstations, corner C is defined by the convergence of a low wall 240 and its corresponding low rim portion 330 and skirt 360, and high wall 270 and its corresponding high rim portion 340 and skirt 360. As shown, the low rim portion 330 on one side of corner C is at a different elevation than the high rim portion 340 on the other side of corner C. That is, the rims 330, 340, while generally parallel to the base, are in different planes. As such, corner C includes a notch between rim 330 and rim 340, and the respective skirts 360, 360 are separated from each other and not continuous around corner C.

Corner D, which may be present on the one or two-drum linkable workstations, is shown in FIGS. 2, 3, and 7. As depicted in detail in FIG. 7, corner D is defined by the convergence of two walls. For two-drum workstations, corner is defined by the convergence of the high end wall 72 and its corresponding high rim portion 140 and skirt 160, and the second offset portion 60 of a side wall and its corresponding high rim portion 140 and skirt 160. As shown, the high rim portions 140, 140 on each side of corner D are at the same elevation. That is, the rims 140, 140, although not continuous and connected around the corner D, are in the same plane parallel to the base portion. However, corner D includes a notch between the two high rim portions 140, 140 and the respective skirts 160, 160 are separated from each other and not continuous around corner D.

For one-drum workstations, corner D is defined by the convergence of two high walls 270, 270 and their corresponding high rim portions 340, 340 and skirts 360, 360. As shown, the high rim portions 340, 340 on either side of corner C are at the same elevation. However, corner D includes a notch between the two high rim portions 340, 340 and the respective skirts 360, 360 are separated from each other and not continuous around corner D.

Corner E, which may be present on the one-drum linkable workstations, is shown in FIGS. 3 and 8. Corner E is a mirror image of corner B depicted in FIG. 5. As seen in detail in FIG. 8, corner E is defined by the convergence of two walls, i.e. a low wall 240 with its corresponding low rim portion 330 and skirt 360, and a high wall 270 with its corresponding high rim portion 340 and skirt 360. As shown the low rim portion 330 on one side of corner E is at a different elevation than the high rim portion 340 on the other side of corner E. As such, corner E includes a notch between rim 330 and rim 340, and the respective skirts 360, 360 are separated from each other and not continuous around corner E.

In one embodiment, all the low rim portions 130, 330 on a workstation are at the same elevation, all the high rim portions 140, 340 are at the same elevation, and the low rim portions are lower in height/elevation than the high rim portions. In one aspect, the low rim portions 130, 330 are about ⅛ of an inch lower than the high rim portions 140, 340, respectively, which may also be about the thickness of the material forming the workstations. It will be appreciated that these dimensions can be adjusted, as need be, to accommodate workstations having a different thickness.

In one aspect, the high rim portions 140, 340 are wider than the respective low rim portions 130, 330. The high rim portions 140, 340 are wider so that they can overlap the respective low rim portions 130, 330 when workstations are linked together.

Nesting of Workstations

In several embodiments, the walls 30 extend upwardly from edges of the base portion 20 and form an angle 90 ("wall angle") so as to facilitate nesting of identical workstations, one stacked within another. To enable nesting, the wall angle 90 (see FIG. 1) between the base 20 and the walls 30 as measured through the reservoir 80, may be greater than 90 degrees and less than 180 degrees. Stacking of several workstations is depicted in FIG. 4, wherein the stack 110, 310 of nested workstations includes a bottom workstation 10A, 210A, a middle workstation 10B, 210B, and a top workstation 10C, 210C.

In one aspect, wherein the nested stack includes a bottom workstation and a top workstation, the base portion and at least a portion of the walls of the top workstation sit inside the reservoir of the bottom workstation. In another aspect, the exterior of the base of the top workstation contacts the interior of the base of the bottom workstation when in a stacked and nested configuration. Because the linkable workstations can be stacked in a nested configuration, the stack 110, 310 occupies less vertical space than a conventional stack of workstations having a comparable sump capacity and which cannot be nested.

It will be appreciated that substantially more than two of the two-drum linkable workstations can be nested one atop another for shipping and storage. Nested workstations according to the invention take up approximately one-third as much vertical space as conventional spill pallets known the art. As will be understood and as seen in FIG. 4, a stack 110, 310 of workstations occupies a vertical height defined by the vertical height of the walls, rim, and skirt of a bottom workstation 10A, 210A, plus the height of the rim and skirt of any additional workstation stacked thereon.

Linking of Workstations

Generally, two workstations (whether they are rectangular workstations 10, substantially square workstations 210, or a combination thereof) may be linked by overlapping a high rim portions 140 or 340 of one workstation over a low rim portion 130 or 330 of another workstation.

Linking of workstations in this way can be accomplished because the high rim portions 140, 340 are higher than the low rim portions 130, 330, and because the high rim portions are wider than the low rim portions. This allows a high rim portion on a first workstation to overlap the low ram portion on a second workstation. Furthermore, the skirt associated with the high rim portion of the first workstation engages an inner surface 31 of a wall 30 on the second workstation. Such linking of two workstations secures the linked workstations to inhibit horizontal movement of the linked workstations relative to each other.

In one embodiment, the high rim portions and associated skirts of the first workstation snuggly engage over the low rim portions and associated skirts of the second workstation. This snug connection, as opposed to simply laying the high rim portion loosely on top of the low rim portion, may require additional force to disengage the connection than merely lifting the first workstation off the second workstation. Such a snug connection is commonly referred to as a "snap on" type connection.

Figure 10:
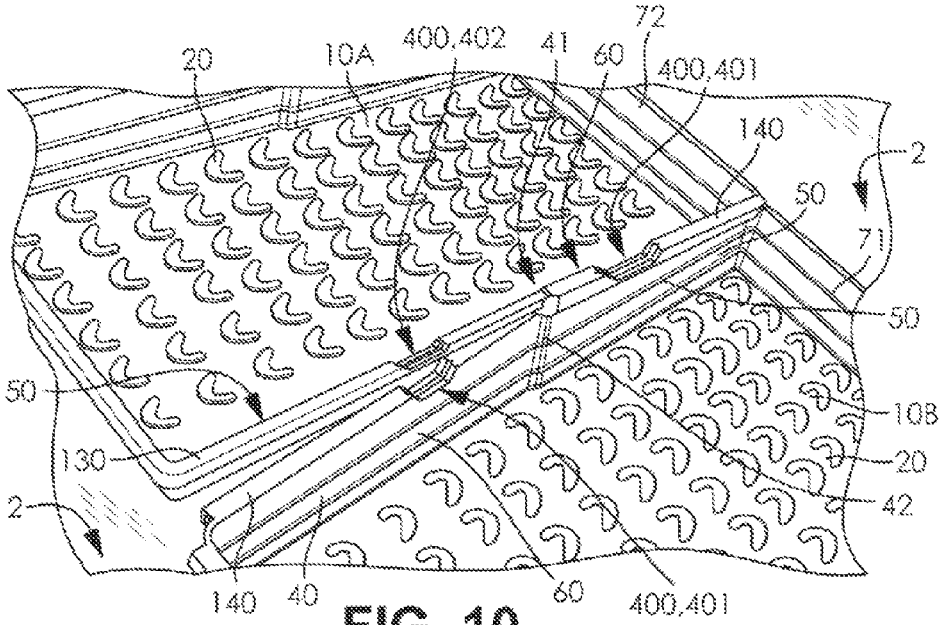
FIGS. 10 and 11 are perspective views of two identical rectangular linkable workstations being joined together at their respective side walls according to an embodiment of the invention.
Figure 11:
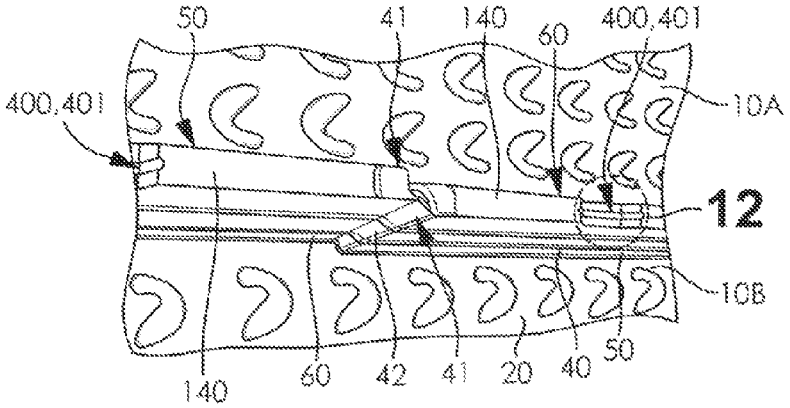

In a particular embodiment, two rectangular linkable workstations 10A, 10B can be linked together along respective side walls 40 as shown in FIGS. 10 and 11. FIG. 10 shows two rectangular workstations 10A, 10B in the process of being linked along their respective side walls on a horizontal or substantially horizontal surface 2, such as a floor. FIG. 11 shows a detail portion of two rectangular workstations 10A, 10B fully linked along their respective side walls.

The two rectangular linkable workstations 10A, 10B may be joined by bringing together and pivoting the workstations at their midpoints 41 in a scissoring manner, so that the high rim portion 140 of workstation 10A can be positioned to overlap the corresponding low rim portion 130 of workstation 10B, and the high rim portion 140 of workstation 10B can at the same time be positioned to overlap the corresponding low rim portion 130 of workstation 10A in order to link the two workstations as shown in FIG. 11.

The linking of the two rectangular workstations 10A, 10B in this manner is facilitated by having i) the first 50 and second 60 offset portions of the side walls 40 being non-coplanar, ii) the high rim portions 140 being higher than the low rim portions 130, iii) the high rim portions 140 being wider than the low rim portions 130, and iv) the skirt 160 on the side walls including the gap 170 between the first 50 and second 60 offset portions at the midpoint 41.

The feature of i) the first 50 and second 60 offset portions being non-coplanar, allows the high rim portion 140 of the second offset portion 60 of workstation 10A to extend toward workstation 10B in order to overlap the low rim portion 130 of the first offset portion 50 of workstation 10B. At the same time, the high rim portion 140 of the second offset portion 60 of workstation 10B can extend toward workstation 10A to overlap the low rim portion 130 of the first offset portion 50 of workstation 10A.

The feature of ii) the high rim portions 140 being higher than the low rim portions 130, allows the high rim portion 140 of the second offset portion 60 of workstation 10A to be positioned above to overlap the low rim portion 130 of the first offset portion 50 of workstation 103. At the same time, the high rim portion 140 of the second offset portion 60 of workstation 10B can be positioned above to overlap the low rim portion 130 of the first offset portion 50 of workstation 10A.

The feature of iii) the high rim portions 140 being wider than the low rim portions 130, allows the skirt 160 on the high rim portions 140 of the second offset portion 60 of workstation 10A to be moved over the low rim portion 130 of workstation 103 to a position inside the reservoir 80 of workstation 103 and optionally in contact with an inner surface 31 of a wall 30 of workstation 103. At the same time, the skirt 160 on the high rim portions 140 of the second offset portion 60 of workstation 10B can be moved over the low rim portion 130 of workstation 10A to a position inside the reservoir 80 of workstation 103 and optionally in contact with the inner surface 31 of a wall 30 of workstation 10A.

Linking of workstations 10A, 103 in this manner may inhibit movement of the workstations 10A, 103 relative to each other a horizontal direction.

The feature of iv) the skirt 160 on the side walls including the gap 170 between the first 50 and second 60 offset portions at the midpoint 41, allows the two workstations 10A, 10B to be brought together and mated at the gaps 170. The two workstations can be brought together at the gaps 170 at an angle relative to each other. The two workstations 10*a*, 10B can then be counter rotated at the gaps 170 so that the workstations brought into plane with each other. Pivoting the two workstations in this manner moves the base 20 of each workstation to be in the same plane and links the workstations by overlapping respective rims and skirts of the two workstations.

In another embodiment, two rectangular linkable workstations 10 can also be linked by mating an end wall 70 of one to end wall 70 of another (e.g. see FIG. 13), wherein the low end wall 71 of one rectangular workstation faces the high end wall 72 of a linked rectangular workstation and the high rim portion 140 of the high end wall 72 overlaps the low rim portion 130 of the low end wall 71.

In another embodiment, two rectangular linkable workstations 10 can also be linked by mating an end wall 70 of one to aside wall 40 of another (e.g. see FIG. 13), wherein the low end wall 71 of one rectangular workstation links with the second offset portion 60 of the side wall 40 of a linked rectangular workstation, and the high rim portion 140 of second offset portion 60 overlaps the low rim portion 130 of the low end wall 71. Alternatively, the high end wall 72 of one rectangular workstation can link with the first offset portion 50 of the side wall 40 of a linked rectangular workstation, and the high rim portion 140 of the high end wall 72 overlaps the low rim portion 130 of the first offset portion 50.

In another embodiment, substantially square workstations 210 are linked (e.g. see FIG. 13), wherein a low wall 240 of one workstation faces a high wall 270 of another workstation, and the high rim portion 340 of the high wall 270 overlaps the low rim portion 330 of the low wall 240.

It will be appreciated that other arrangements, which include different numbers of two-drum and/or one-drum linkable workstations, could be formed, if desired. For example, a one-drum linkable workstation 210 can be joined to a two-drum linkable workstation 10 (e.g. see FIG. 13), wherein a high rim portion 340 and associated skirt 360 of a high wall 270 of the one-drum linkable workstation 210 can be snapped over a low rim portion 130 and associated skirt 160 of the low end wall 71 or first offset portions 50 of the two-drum workstation 10. Alternatively, a high rim portion 140 and associated skirt 160 of a high end wall 72 or second offset portions 60 of a two-drum workstation 10 can be positioned to overlap a lower rim portion 330 and associated skirt 360 of a low wall 240 of a one-drum workstation 210.

Figure 13:
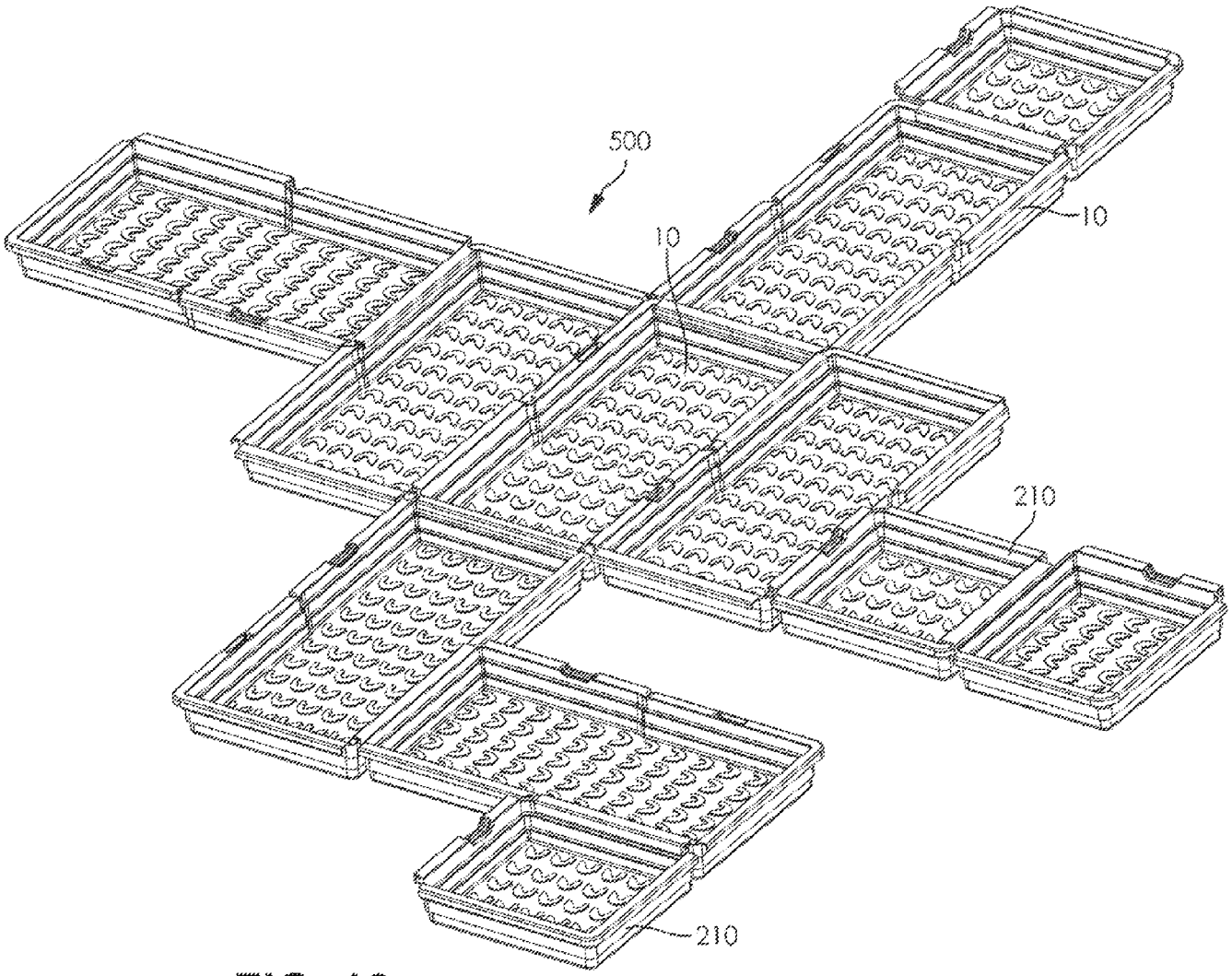
FIG. 13 is a perspective view of a linked arrangement of rectangular and substantially square linkable workstations according to the invention.

FIG. 13 shows an arrangement 500 that includes seven two-drum linkable workstations 10 and four one-drum linkable workstations 210 arranged and linked in a large work group. The sump capacity of the several workstations in the arrangement may be shared or isolated as desired, as explained in more detail herein.

In several embodiments in accordance with the present subject matter, the reservoirs of two or more linkable workstations can be fluidly connected so that the sump capacity of linked workstations can be shared in order to contain liquids that may leak from a drum residing in or above one of the workstations. In this regard, workstations can include overflow channels (also sometimes referred to as "sluiceways"). When two or more workstations are linked, the overflow channels in respective workstations can be aligned and overlapped during linking to thereby fluidly connecting the reservoirs of the linked workstations.

In several embodiments, the linkable workstations include at least one depression in a rim portion that defines at least one overflow channel. The linkable workstations can include one or more overflow channels. In one embodiment, a two-drum linkable workstation includes two overflow channels. In another embodiment, a one-drum linkable workstation includes one overflow channel. In other embodiments, one or less overflow channels are provided in the workstations.

In accordance with several embodiments, overflow channels are located at a top of a wall of the workstations, and laterally cross a rim portion. Exemplary overflow channels are shown for example in FIGS. 2, 3, 10-12, 14, and 15.

Figure 14:
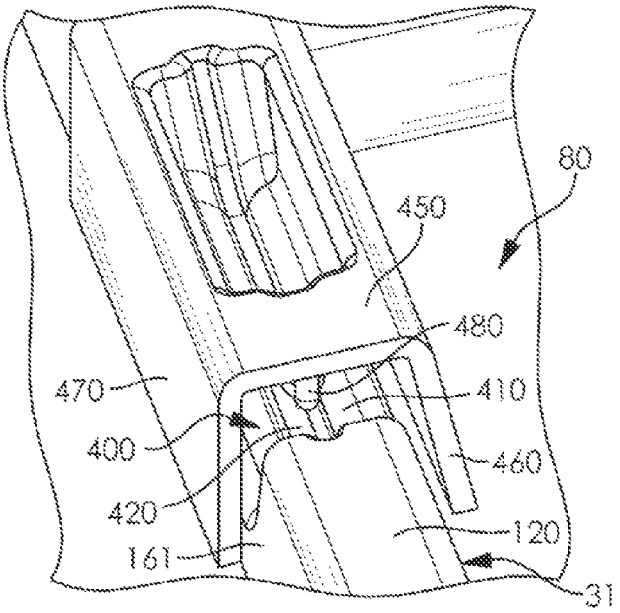
FIG. 14 is a perspective view of an overflow channel shut-off about to placed over an overflow channel of a linkable workstation according to the invention.

Generally, as best seen in FIG. 14, a rim portion 120 can include a depression 410, which defines an overflow channel 400. The overflow channel 400 can run laterally across the rim portion 120 from the reservoir 80 to outside the reservoir. In several embodiments, a top surface of the depression 410 is lower than a top surface of all rim portions 120. As such, as liquid levels rise in the reservoir, liquid can escape first from the reservoir 80 through the overflow channel 400, rather than over the top of the rim portions 120.

Overflow channels 400 can be formed in low rim portions 130, 330 and in high rim portions 140, 340 in either one- or two-drum workstations. As best seen in FIGS. 2, 10-12, an exemplary two-drum workstation 10 includes an overflow channel 401 in a high rim portion 140 and an overflow channel 402 in a low rim portion 130. As shown, the two overflow channels 401, 402 are both located on the same wall. The present subject matter includes overflow channels in more than one wall; for example in one or more side walls and in one or more end walls as desired.

In one aspect, an upper surface of both overflow channels 401, 402 are lower than the upper surface of all low rim portions 130, 330 on a one-drum 210 or two-drum 10 workstation. As such, liquid building up in the reservoir can escape first from the reservoir 80, 280 through the overflow channels 401, 402 rather than over the top of the low rim portions 130, 330.

FIGS. 2, 10 and 11 show two-drum m workstations 10 having two overflow channels 401, 402. As seen, one overflow channel 401 is provided at the top of the second offset portion 60 of a side wall 40, and laterally crosses the associated high rim portion 140. Another overflow channel 402 is provided at the top of the first offset portion 50 of a side wall 40, and laterally crosses the associated low rim portion 130. In one embodiment, overflow channel 401 is wider than overflow channel 402 and thus can overlap an overflow channel 402 on a linked workstation.

FIG. 3 shows a similar overflow channel 400 in a one-drum workstation 210. As seen, the overflow channel 401 is provided at the top of a high wall 270, and laterally crosses the associated high rim portion 340. As will be appreciated, the one-drum workstation 210 can alternatively or additionally include an overflow channel 402 provided at the top of a low wall 240, and laterally crossing an associated low rim portion 330.

Figure 12:
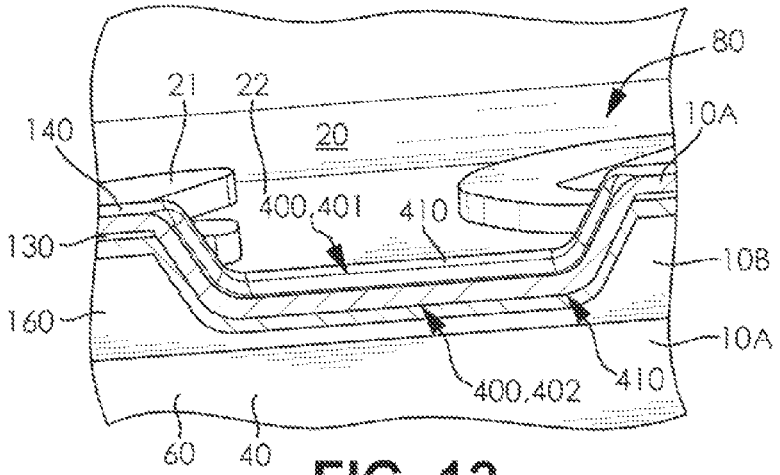
FIG. 12 is a cross-sectional view taken through two joined linkable workstations at an overflow channel.

As can be seen in FIGS. 10-12, when two workstations 10A, 10B are linked, the overflow channel 401 in a high rim portion 140 of workstation 10A is aligned and overlaps the overflow channel 402 in a low rim portion 130 of workstation 10B, and the overflow channel 401 in a high rim portion 140 of workstation 10B is aligned and overlaps the overflow channel 402 in a low rim portion 130 of workstation 10A. In this way, two overflow channels 400 are provided to fluidly link the reservoirs of workstations 10A and 10B (FIG. 11).

FIG. 12 is a detailed portion of FIG. 11 inside hashed circle 12, and is a section view taken at overlapping overflow channels 401, 402 along the joint between the two linked workstations 10A, 10B. As seen, the depression 410 in the high rim portion 140 of workstation 10A forms overflow channel 401. The depression 410 in the low rim portion 130 of workstation 10B forms overflow channel 402. When the two workstations 10A and 10B are linked, the overflow channel 401 of workstation 10A overlaps overflow channel 402 of workstation 103. As such, the reservoirs of the two workstations are fluidly connected. Accordingly, as liquid levels rise in either reservoir, liquid can first flow through the overflow channel 401 from one reservoir to the other, rather than over the top of a rim portion 120 of the workstations.

That is, accumulating in the reservoir of one linkable workstation can flow into the reservoir of the adjacent, linked workstation via the overflow channel, thereby effectively adding to the liquid-containment capacity of the workstation in which a leaking drum is contained.

It will be understood that overflow channels are not limited to being on a single side of a one or two-drum workstation, but can be formed at any desired location on the workstations. Additionally, any number of overflow channels, for example two or more, can be provided on the workstations to allow for custom arrangements of two or more workstations with fluidly connected reservoirs/receptacles.

In some instances, it may be desirable to close off an overflow channel(s) to fluidly isolate the reservoir of a workstation, or a reservoir of one workstation from the reservoir of its adjacent, linked workstation.

Figure 15:
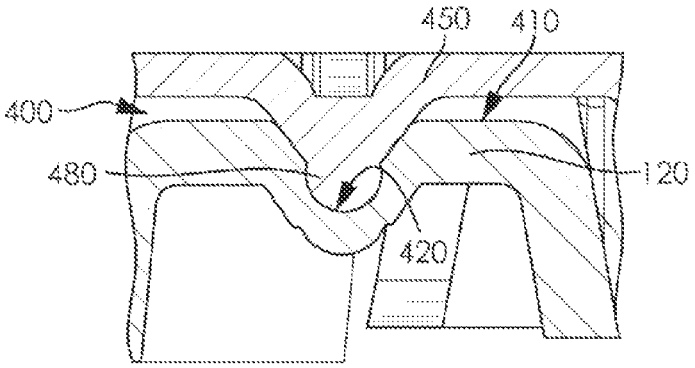
FIG. 15 is a cross-sectional view taken perpendicular to the side wall of a linkable workstation at the overflow channel with an overflow channel shut-off installed.

In one embodiment, workstations include an overflow channel cover or overflow shut-off 450, depicted for example in FIGS. 14 and 15. The shut-off 450 may be positioned relative to the workstation to selectively restrict flow of liquid through an overflow channel 400. For example, the overflow shut-off 450 may be selectively inserted into an overflow channel 400 to close off the overflow channel. In one embodiment, the overflow channel cover 450 includes a bead 480, which may be generally round in cross section, and the depression 410 in the rim 120 can include a corresponding trough 420. The trough 420 can have a corresponding size and shape with respect to the bead 480 to thereby selectively engage the bead 480 to securely hold the shut-off 450 in the overflow channel 400. This engagement between the trough 420 and bead 480 may effectively block the flow of liquid through the overflow channel 400. The engagement between the trough 420 and bead 480 may comprise a snug fit, such as a snap on type connection wherein removal of the overflow channel cover 450 from the overflow channel 400 requires more effort than simply lifting the overflow channel cover.

The overflow channel cover 450 can include an inner wall 460 and an outer wall 470. In one embodiment, when the overflow shut-off 450 is inserted in the overflow channel 400, wherein the trough 420 engages the bead 480, the inner wall 460 of the shut-off 450 contacts an inner surface 31 of a wall 30 of the workstation; and the outer wall 470 contacts an outer surface 161 of a skirt 160 of the workstation.

As shown FIG. 15, which is a section view taken through an overflow channel 400 on which a shut-off 450 has been installed, the shut-off 450 seals the overflow channel 400 by snapping in place, wherein the bead 480 is fittingly engaged in the trough 420. That is, the round bead 480 of the shut-off 450 snaps into the round trough 420 formed in the depression 410 in the rim. This engagement between the cover 450 and the overflow channel 400 can seal the overflow channel and inhibit liquid that is accumulating in the reservoir from flowing through the overflow channel.

Other types of sealing mechanisms can be used to seal off the overflow channels, including angled type interference fittings between linked workstations, gaskets, etc. Furthermore, overflow channels can optionally be permanently sealed off using adhesives, if desired. As will be understood, by using the overflow channel cut-off 450, the overflow channels 400 can be sealed quickly and easily and without the use of tools.

It will be will also appreciated that overflow shut-offs 450 can be configured to seal overflow channels 401 that laterally cross high rim portions 140, and also to seal overflow channels 402 that laterally cross low rim portions 130. This allows for one configuration of the shut-off 450 to have the ability to seal all overflow channels. The present subject matter provides for multiple configurations of linked workstations and virtually endless arrangements of linked workstations with shared or isolated reservoirs.

Various methods for containing liquid escaping from a container are provided herein. One preferred method utilizes a first linkable workstation and a second linkable workstation, each comprising a base portion configured to rest on a surface, and walls extending upwardly from the base portion and terminating at rim portions having downwardly extending skirts.

The walls cooperate with the base portion to define a reservoir for liquids. The rim portions comprise a plurality of high rim portions and a plurality of low rim portions. The plurality of high rim portions are at an elevation that is higher than an elevation of the plurality of low rim portions.

The first workstation includes a depression defining an overflow channel at a top of a wall and laterally crossing one of the plurality of high rim portions of the first workstation. The second workstation includes a depression defining an overflow channel at a top of a wall and laterally crossing one of the plurality of low rim portions of the second workstation.

The one or two-drum linkable workstations as shown in the various figures can be used in the method and the first and second workstations can comprise more overflow channels as desired. Additionally, more workstations can be linked to the first and second workstations as desired to from an arrangement of workstations having shared or isolated sump capacities as desired.

The method includes placing a container, having liquid escaping therefrom, over the reservoir of at least one of the first and second workstations. The first and second workstations are linked such that the overflow channel of the first workstation overlaps the overflow channel of the second workstation to thereby fluidly connect the reservoir of the first workstation with the reservoir of the second workstation.

In a preferred embodiment, a two-drum linkable workstation 10 is about 32" wide and 57" long and has a depth measured at a low rim portion of about 6", and can accommodate two drums, which are typically cylindrical and about 26" in diameter at the base. When two two-drum linkable workstations 10 are linked to share their sump capacities as described above, their combined sump capacity may be about 66 gallons or more, which allows two two-drum linkable workstations in a linked arrangement to satisfy various compliance regulations for the storage of 55-gallon standard drums. As will be understood, the various dimensions of width, length, and height can be adjusted relative to each other, while maintaining the same sump capacity of about 66 gallons or more. For example, the length of the workstation 10 can be shortened and the width can be increased while maintaining the same sump capacity.

A one-drum linkable workstation may have a sump volume capacity of about 19 gallons. It will be appreciated that the dimensions, volumes and linking arrangements can be varied within the scope of the invention. The one- or two-drum linkable workstations are unique because they can have low wall heights, which may be desirable in some circumstances, yet the sump capacity of the workstations can be increased by fluidly linking them with other workstations.

Furthermore, linkable workstations as described herein can be configured to provide customized spill protection in work areas, without requiring a large space for storage of multiple workstations. Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

Covers and Shields

In accordance with the present subject mater, the workstations can include one or more attachments that can attach to the workstation to modify or enhance its configuration or functions. The attachments may connect with the workstation at the rim and skirt, or at the overflow channel in a similar way to the overflow channel cover.

In several embodiments, the linkable workstations include one or more covers or shields removably attached to the workstation for containing, blocking, or otherwise segregating the reservoir and/or a drum in the reservoir from the environment. The covers and shields can be used a splash guard or vapor guard to help contain liquid or evaporating liquid in the reservoir of the workstation. The covers and shields can be made from the same or different material as the workstations and can be made by the same or different forming processes.

Figure 16:
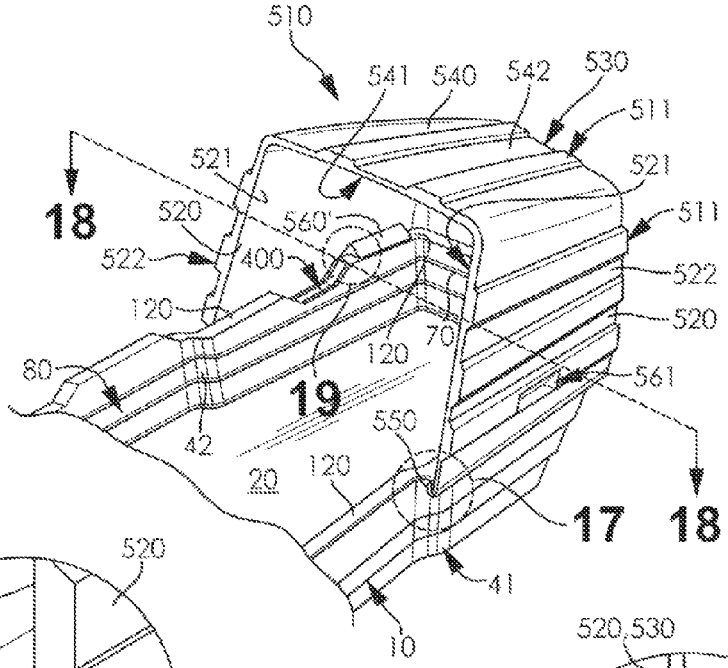
FIG. 16 is a perspective view of a linkable workstation and a cover attached to the workstation according to an embodiment of the invention.

In one embodiment, one or more covers are attached to the workstation, for example as depicted in FIGS. 16-20. In accordance with the present subject matter and as seen in FIG. 16, a cover 510 can include two side panels 520, an end panel 530, and a top panel 540. It will be understood that the cover 510 can include more or less panels as desired, such as not including a top panel 540 for example.

Figure 20:
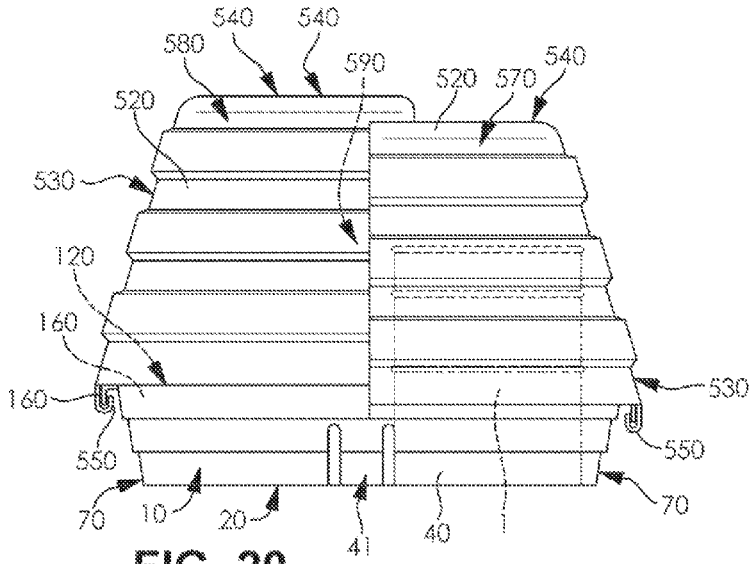
FIG. 20 is a partial see-through side view of a linkable workstation having two covers attached thereto according to an embodiment of the invention.

As shown in FIG. 20, the workstation 10 can include a first cover 570 and a second cover 580 attached thereto that substantially enclose a drum 1 in an interior 590 collectively defined by the workstation 10, the first cover 570, and the second cover 580. The first cover 570 and second cover 580 are shown to generally meet at the midpoint 41 of the workstation 10, however this is not required and the covers 580, 590 can meet at other than the midpoint 41 or not meet.

Figure 21:
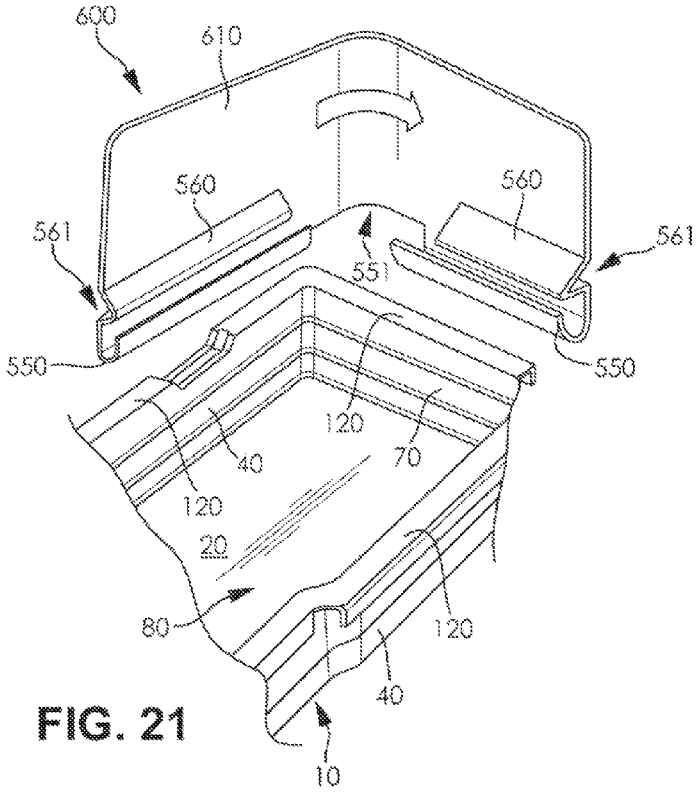
FIG. 21 is a perspective view of a linkable workstation and shield according to an embodiment of the invention

In another embodiment, the workstation can include one or more shields or splash guards attached thereto, for example as depicted in FIG. 21. As seen in FIG. 21, a shield 600 comprising a bendable panel 610 is bent as depicted by the arrow at approximately 90 degrees and attached to the workstation 10.

Attachment mechanisms used to connect a shield 600 or a cover 510 to a workstation can comprise various configurations, and in one embodiment in accordance with the present subject matter, the covers and shields include hooks 550 formed on the bottom edges of various panels, and corresponding ledges 560 on inside surfaces of the panels. The hooks 550 and ledges 560 cooperate to engage corresponding rims 120 and skirts 160 on the workstation 10 in order to attach thereto. As shown, the hooks 550 may comprise a bend in the bottom edge of the panels, and the ledges 560 may comprise an indentation 561 in the panels.

Figure 17:
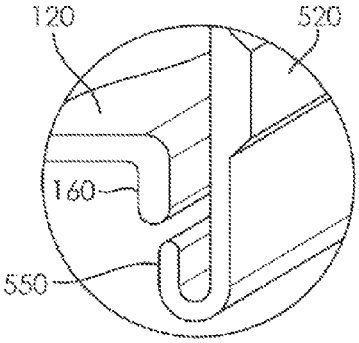
FIG. 17 is a detailed view of engagement between a hook on a panel and a skirt on a linkable workstation according to an embodiment of the invention.
Figure 19:
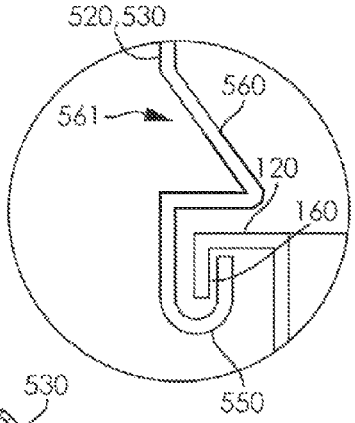
FIG. 19 is a cross-sectional view of respective engagement between a hook and a ledge on a panel and a skirt and a rim of a linkable workstation according to an embodiment of the invention.

Exemplary engagement between a hook 550 (from a cover 510 or shield 600) and the skirt 160 on a workstation 10 can be seen in detail in FIG. 17, wherein the arrow indicates movement of the hook 550 to engage the skirt 160. FIG. 19 depicts exemplary engagement between a hook 550 and a ledge 560 (from a cover 510 or shield 600) with a skirt 160 and a rim 120 of a workstation, wherein the hook 550 generally engages the skirt 160 by catching the skirt 160, and the ledge 560 generally engages the rim 120 by sitting on the rim 120. The mutual engagement between the hook 550 and the skirt 160 and between the ledge 560 and the rim 120 can operate to secure the cover 510 or shield 600 to the workstation. In one embodiment, the hooks 550 and ledges 560 are positioned relative to each other to tightly engage, or "clip" onto, the rims 120 and skirts 160 of the workstation.

Figure 18:
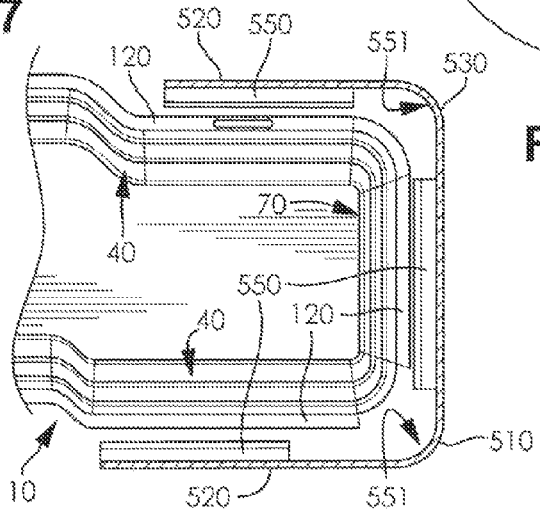
FIG. 18 is a top cross-sectional view taken through the cover on the linkable workstation of FIG. 16.

As shown in FIG. 18, the cover 510 may include a hook 550 and a corresponding ledge 560 on each of the side panels 520 and end panel 530 to engage two side walls 40 and the end wall 70, respectively, or the workstation. As shown in FIG. 21, the shield 600 may include a hook 550 and a corresponding ledge 560 on each end of the bendable panel 610 to engage one or two walls of the workstation. For example, when the panel 610 is bent as shown in FIG. 21, one hook 550 and the corresponding ledge 560 may engage the rim and skirt of a side wall 40, and the other hook 550 and the corresponding ledge 560 may engage the rim and skirt of the end wall 70 as shown. However, when the panel 610 is not bent, the hooks 550 and ledges 560 may engage the rim and skirt along the full length of the side wall 40.

In accordance with one embodiment, and as shown in FIG. 18, the hooks 550 of the cover 510 may not extend the full lengths of the side panels 520 or the end panel 530. Rather, a discontinuity 551 between the hooks 550 may exist at the corners where the side panels 520 meet the end panel 530. As shown in FIG. 16, the ledge 560 and the indentation 561 also do not extend a full length of the side panels 520. Although not shown, the same may be true for the end panel 530. Similarly, as shown in FIG. 21, the hooks 550 of the shield 600 do not extend the full length of the bendable panel 610, but include a discontinuity 551 between the two hooks 550 where the bendable panel 610 may be bent. Also, the ledges 560 to not extend the full length of the bendable panel 610.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scopes of the claimed subject matter, as expressed in the appended claims.

What is claimed is:

1. A linkable workstation comprising:

a base portion configured to rest on a surface, and walls extending upwardly from the base portion and terminating at rim portions having downwardly extending skirts, and a depression in a rim portion that defines an overflow channel at a top of a wall and that laterally crosses the rim portion, wherein the walls cooperate with the base portion to define a reservoir for liquids, wherein the walls are angled with respect to the base portion so as to allow substantially identical workstations to be stacked one atop another in a nested configuration, wherein the rim portions comprise a plurality of high rim portions and a plurality of low rim portions, the plurality of high rim portions being at an elevation that is higher than an elevation of the plurality of low rim portions, and wherein the workstation is linkable to another workstation that comprises a rim portion that is identical to one of the plurality of low rim portions or one of the plurality of high rim portions, by overlapping one of the plurality of low rim portions or one of the plurality of high rim portions of the workstation with the rim portion of the other workstation having a different elevation.

2. The linkable workstation of claim 1, wherein the base portion includes a land area and a plurality of raised portions extending upwardly from the land area.

3. The linkable workstation of claim 1, wherein:

the base portion of the workstation is rectangular in shape and has two longer edges and two shorter edges, the walls comprise two side walls and two end walls, the side walls being longer than the end walls, each of the side walls extends upwardly from one of the longer edges of the rectangular base portion, and each of the end walls extends upwardly from one of the shorter edges of the rectangular base portion.

4. The linkable workstation according to claim 1, further comprising a removable overflow shut-off configured to selectively close off the overflow channel.

5. The linkable workstation according to claim 4, wherein the depression includes a trough configured to engage a bead on the overflow shut-off to selectively secure the overflow shut-off in the overflow channel.

6. The linkable workstation according to claim 5, wherein:

the overflow shut-off comprises an inner wall and an outer wall, and when the overflow shut-off is secured in the overflow channel, the inner wall is configured to engage an inner surface of a wall of the workstation and the outer wall is configured to engage an outer surface of a skirt of the workstation.

7. A linkable workstation comprising:

a base portion configured to rest on a surface, and walls extending upwardly from the base portion and terminating at rim portions having downwardly extending skirts, wherein the walls cooperate with the base portion to define a reservoir for liquids, wherein the walls are angled with respect to the base portion so as to allow substantially identical workstations to be stacked one atop another in a nested configuration, wherein the rim portions comprise a plurality of high rim portions and a plurality of low rim portions, the plurality of high rim portions being at an elevation that is higher than an elevation of the plurality of low rim portions, wherein the workstation is linkable to another workstation that comprises a rim portion that is identical to one of the plurality of low rim portions or one of the plurality of high rim portions, by overlapping one of the plurality of low rim portions or one of the plurality of high rim portions of the workstation with the rim portion of the other workstation having a different elevation, wherein:

the base portion of the workstation is rectangular in shape and has two longer edges and two shorter edges, the walls comprise two side walls and two end walls, the side walls being longer than the end walls, each of the side walls extends upwardly from one of the longer edges of the rectangular base portion, and each of the end walls extends upwardly from one of the shorter edges of the rectangular base portion, and wherein each of the side walls comprises a first offset portion and a second offset portions and wherein the first and second offset portions are non-coplanar to each other.

8. The linkable workstation of claim 7, wherein each of the side walls includes a shoulder transitioning between the first and second offset portions.

9. The linkable workstation of claim 7, wherein:

the first offset portion of the side walls terminates at one of the plurality of low rim portions, the second offset portion terminates at one of the plurality of high rim portions.

10. The linkable workstation of claim 9, wherein a side wall of the workstation is linkable to an identical side wall of another workstation, such that a high rim portion of the second offset portion of the workstation is configured to overlap a low rim portion of the first offset portion of the other workstation, and a low rim portion of the first offset portion of the workstation is configured to be overlapped by a high rim portion of the second offset portion of the other workstation.

11. The linkable workstation of claim 9, wherein:

a first end wall terminates at one of the plurality of low rim portions, and a second end wall terminates at one of the plurality of high rim portions.

12. The linkable workstation of claim 11, wherein the plurality of low rim portions are at the same elevation and the plurality of high rim portions are at the same elevation.

13. A linkable workstation of claim 1 comprising:

a base portion configured to rest on a surface, and walls extending upwardly from the base portion and terminating at rim portions having downwardly extending skirts, wherein the walls cooperate with the base portion to define a reservoir for liquids, wherein the walls are angled with respect to the base portion so as to allow substantially identical workstations to be stacked one atop another in a nested configuration, wherein the rim portions comprise a plurality of high rim portions and a plurality of low rim portions, the plurality of high rim portions being at an elevation that is higher than an elevation of the plurality of low rim portions, wherein the workstation is linkable to another workstation that comprises a rim portion that is identical to one of the plurality of low rim portions or one of the plurality of high rim portions, by overlapping one of the plurality of low rim portions or one of the plurality of high rim portions of the workstation with the rim portion of the other workstation having a different elevation, and wherein:

the base portion of the workstation is substantially square in shape, the walls comprise four walls, two walls of the four walls each terminate at one of the plurality of high rim portions and another two walls of the four walls each terminate at one of the plurality of low rim portions.

14. The linkable workstation of claim 13, wherein the two low rim portions are adjacent to each other and the two high rim portions are adjacent to each other.

15. A linkable workstation comprising:

a base portion configured to rest on a surface, walls extending upwardly from the base portion and terminating at rim portions having downwardly extending skirts, and a splash guard attached to the workstation, wherein the walls cooperate with the base portion to define a reservoir for liquids, wherein the walls are angled with respect to the base portion so as to allow substantially identical workstations to be stacked one atop another in a nested configuration, wherein the rim portions comprise a plurality of high rim portions and a plurality of low rim portions, the plurality of high rim portions being at an elevation that is higher than an elevation of the plurality of low rim portions, and wherein the workstation is linkable to another workstation that comprises a rim portion that is identical to one of the plurality of low rim portions or one of the plurality of high rim portions, by overlapping one of the plurality of low rim portions or one of the plurality of high rim portions of the workstation with the rim portion of the other workstation having a different elevation, and wherein:

the splash guard includes one or more panels with a hook and a ledge at a bottom of each of the one or more panels, and the hook engages a skirt of the workstation and the ledge engages a rim portion of the workstation to thereby attach the splash guard to the workstation such that the one or more panels extends upwardly from the workstation.

16. The linkable workstation according to claim 15, wherein:

the splash guard includes two side panels and an end panel, each including a hook and a ledge, and a top panel connected to the two side panels and the end panel, a hook and a ledge of each of the side panels engage a skirt and rim portion of a side wall of the workstation, and a hook and a ledge of the end panel engage a skirt and rim portion of an end wall of the workstation.

* * * * *